US011326221B2

(12) United States Patent
Song et al.

(10) Patent No.: US 11,326,221 B2
(45) Date of Patent: May 10, 2022

(54) GRAIN-ORIENTED ELECTRICAL STEEL SHEET AND MANUFACTURING METHOD THEREFOR

(71) Applicant: POSCO, Pohang-si (KR)

(72) Inventors: Dae Hyun Song, Pohang-si (KR); Seung Il Kim, Pohang-si (KR); June Soo Park, Pohang-si (KR); Il Nam Yang, Pohang-si (KR)

(73) Assignee: POSCO, Pohang-Si (KR)

( * ) Notice: Subject to any disclaimer, the term of this patent is extended or adjusted under 35 U.S.C. 154(b) by 131 days.

(21) Appl. No.: 16/471,288

(22) PCT Filed: Dec. 13, 2017

(86) PCT No.: PCT/KR2017/015125
§ 371 (c)(1),
(2) Date: Jun. 19, 2019

(87) PCT Pub. No.: WO2018/117639
PCT Pub. Date: Jun. 28, 2018

(65) Prior Publication Data

US 2020/0017930 A1 Jan. 16, 2020

(30) Foreign Application Priority Data

Dec. 21, 2016 (KR) ..... 10-2016-0175333

(51) Int. Cl.

| | |
|---|---|
| ***C21D 9/46*** | (2006.01) |
| ***C21D 6/00*** | (2006.01) |
| ***C21D 8/00*** | (2006.01) |
| ***C21D 8/12*** | (2006.01) |
| ***C22C 38/00*** | (2006.01) |
| ***C22C 38/04*** | (2006.01) |
| ***C22C 38/06*** | (2006.01) |
| ***C22C 38/34*** | (2006.01) |
| ***C22C 38/40*** | (2006.01) |
| ***H01F 1/147*** | (2006.01) |

(52) U.S. Cl.
CPC ..... *C21D 9/46* (2013.01); *C21D 6/004* (2013.01); *C21D 6/005* (2013.01); *C21D 6/008* (2013.01); *C21D 8/005* (2013.01); *C21D 8/1272* (2013.01); *C22C 38/001* (2013.01); *C22C 38/002* (2013.01); *C22C 38/008* (2013.01); *C22C 38/04* (2013.01); *C22C 38/06* (2013.01); *C22C 38/34* (2013.01); *C22C 38/40* (2013.01); *H01F 1/14775* (2013.01)

(58) Field of Classification Search
CPC ..... C21D 9/46; C22C 38/04
USPC ..... 148/111
See application file for complete search history.

(56) References Cited

U.S. PATENT DOCUMENTS

2002/0011278 A1* 1/2002 Komatsubara ..... C22C 38/04 148/120

FOREIGN PATENT DOCUMENTS

| | | | | |
|---|---|---|---|---|
| CN | 105008555 | A | | 10/2015 |
| CN | 105008557 | A | | 10/2015 |
| CN | 105579596 | A | | 5/2016 |
| JP | 2005-039963 | A | | 2/2005 |
| JP | 2005-042168 | A | | 2/2005 |
| JP | 2005-094940 | A | | 4/2005 |
| JP | 2005-105407 | A | | 4/2005 |
| KR | 10-2006-0032791 | A | | 4/2006 |
| KR | 10-2006-0074647 | A | | 7/2006 |
| KR | 10-2011-0036390 | A | | 4/2011 |
| KR | 10-2012-0072927 | A | | 7/2012 |
| KR | 10-2014-0007586 | A | | 1/2014 |
| KR | 20140007586 | A | * | 1/2014 |
| KR | 10-2014-0058939 | A | | 5/2014 |
| KR | 10-2015-0073551 | A | | 7/2015 |
| KR | 10-2015-0074816 | A | | 7/2015 |
| KR | 10-2016-0072704 | A | | 6/2016 |

OTHER PUBLICATIONS

Written Opinion and International Search Report dated May 14, 2018 issued in International Patent Application No. PCT/KR2017/015125 (with English translation).
Chinese Office Action dated Jul. 1, 2020 issued in Chinese Patent Application No. 201780078747.0.
Chinese Office Action dated Jul. 28, 2021 issued in Chinese Patent Application No. 201780078747.0.

* cited by examiner

*Primary Examiner* — Weiping Zhu
(74) *Attorney, Agent, or Firm* — Morgan, Lewis & Bockius LLP

(57) ABSTRACT

According to an exemplary embodiment of the present invention, a manufacturing method of a grain-oriented electrical steel sheet, includes: preparing a slab; heating the slab; forming a hot-rolled sheet by hot-rolling the slab; performing hot-rolled sheet annealing on the hot-rolled sheet; forming a cold-rolled sheet by cold-rolling the hot-rolled sheet that has been completely subjected to the hot-rolled sheet annealing; performing first recrystallization annealing on the cold-rolled sheet; and performing second recrystallization annealing on the cold-rolled sheet that has been completely subjected to the first recrystallization annealing, wherein the hot-rolled sheet undergoes a first heating step, a second heating step, and a soaking step, and a temperature rise rate $t_1$ of the first heating step and a temperature rise rate $t_2$ of the second heating step satisfy Formula 1.

$$5 \times t_2 \leq t_1 \quad \text{[Formula 1]}$$

6 Claims, 4 Drawing Sheets

GRAIN-ORIENTED ELECTRICAL STEEL SHEET AND MANUFACTURING METHOD THEREFOR

CROSS-REFERENCE OF RELATED APPLICATIONS

This application is the U.S. National Phase under 35 U.S.C. § 371 of International Patent Application No. PCT/KR2017/015125, filed on Dec. 13, 2017, which in turn claims the benefit of Korean Patent Application No. 10-2016-0175333, filed Dec. 21, 2016, the entire disclosures of which applications are incorporated by reference herein.

TECHNICAL FIELD

This relates to a grain-oriented electrical steel sheet and a manufacturing method thereof. More specifically, this relates to a grain-oriented electrical steel sheet and a manufacturing method thereof, capable of simultaneously achieving improvement in cold rolling productivity and magnetic properties.

BACKGROUND ART

A grain-oriented electrical steel sheet is a soft magnetic material having an excellent magnetic property in one direction or a rolling direction because it shows Goss texture in which the texture of the steel sheet in the rolling direction is {110}<001>.

The quality and quantity of the Goss texture are attributed to texture of the hot-rolled sheet, and process control factors that can perform second recrystallization without damaging the Goss texture as much as possible through heat treatment of hot-rolled sheet annealing, cold rolling, and first recrystallization annealing are very important for commercial purposes. An origin of the Goss texture is roughly classified into two groups: hot-rolled sheet texture and cold rolling texture, as is known by many scholars.

In the hot-rolled sheet texture, a hot-rolled sheet annealing process becomes important in the sense of optimizing the hot-rolled sheet texture in the hot-rolled sheet annealing process which is a post process. The cold rolling texture starts from the hot-rolled sheet texture that has already been controlled through annealing of the hot-rolled sheet, which is a post-process of hot rolling, and as a result, the hot-rolled sheet annealing process is very important in both cases.

The heat treatment of the hot-rolled sheet annealing may be largely divided into 3 steps: a first step which is a heating step for heating the hot-rolled sheet to re-solid-dissolve coarse precipitates and impurities and relatively homogeneously controlling microtexture of the hot-rolled sheet; a second step which is a soaking step for finely performing precipitation control on the precipitates re-solid-dissolved in the heating step and stabilizing the microtexture of the heating step; and a third step which is a cooling step for stably maintaining the precipitates and the microtexture controlled in the soaking step up to room temperature.

A technique for improving productivity of the grain-oriented electrical steel sheet by annealing the hot-rolled sheet at a temperature range of 700 to 1000° C. for 2 minutes or less has been proposed, but when annealing of the hot-rolled sheet is performed at the above temperature range, it is not easy to uniformly and finely distribute the precipitates, which may lead to a problem of worsening deviation of the magnetic quality.

DISCLOSURE

An exemplary embodiment of the present invention has been made in an effort to provide a grain-oriented electrical steel sheet and a manufacturing method thereof. More specifically, it has been made in an effort to provide a grain-oriented electrical steel sheet and a manufacturing method thereof, capable of simultaneously achieving improvement in cold rolling productivity and magnetic properties.

According to an exemplary embodiment of the present invention, a manufacturing method of a grain-oriented electrical steel sheet includes: preparing a slab; heating the slab; forming a hot-rolled sheet by hot-rolling the slab; performing hot-rolled sheet annealing on the hot-rolled sheet; forming a cold-rolled sheet by cold-rolling the hot-rolled sheet that has been completely subjected to the hot-rolled sheet annealing; performing first recrystallization annealing on the cold-rolled sheet; and performing second recrystallization annealing on the cold-rolled sheet that has been completely subjected to the first recrystallization annealing, wherein the hot-rolled sheet undergoes a first heating step, a second heating step, and a soaking step, and a temperature rise rate $t_1$ of the first heating step and a temperature rise rate $t_2$ of the second heating step satisfy Formula 1.

$$5 \times t_2 \leq t_1 \quad \text{[Formula 1]}$$

The first heating step may be a step of heating the hot-rolled sheet to 600 to 900° C., and the second heating step may be a step of heating the hot-rolled sheet that has been completely subjected to the first heating step to a soaking temperature of the soaking step.

The temperature rise rate $t_1$ may be in a range of 5 to 45° C./s.

The soaking step may include a first soaking step and a second soaking step, and a soaking temperature of the first soaking step may be in a range of 850 to 1150° C.

A soaking temperature of second soaking step may be in a range of 850 to 950° C.

The slab may include Si (2.0 to 6.0 wt %), Al (0.05 wt % or less excluding 0 wt %), Mn (0.20 wt % or less excluding 0 wt %), P (0.08 wt % or less excluding 0 wt %), C (0.1 wt % or less excluding 0 wt %), N (0.01 wt % or less excluding 0 wt %), and S (0.01 wt % or less excluding 0 wt %), and a remainder may include Fe and other inevitable impurities.

The slab may further include 0.003 to 0.10 wt % of at least one element of Sb, Sn, Cr, Ni, Y, Ba, B, La, Mo, and Ce.

The hot-rolled sheet that has been completely subjected to the hot-rolled sheet annealing may have Vickers hardness of 250 Hv or less after the performing of the hot-rolled sheet annealing.

The hot-rolled sheet may have a strain hardening exponent of 0.2 or more after the performing of the hot-rolled sheet annealing.

A number of crystal grains having a diameter of 5 mm or less in the steel sheet may be 10/5×5 $cm^2$ or less after performing of the second recrystallization annealing.

The grain-oriented electrical steel sheet according to an exemplary embodiment of the present invention may further include Si (2.0 to 6.0 wt %), Al (0.05 wt % or less excluding 0 wt %), Mn (0.20 wt % or less excluding 0 wt %), P (0.08 wt % or less excluding 0 wt %), C (0.05 wt % or less excluding 0 wt %), N (0.0001 to 0.05 wt %), and S (0.01 wt % or less excluding 0 wt %), and a remainder may include Fe and other inevitable impurities. In addition, a number of crystal grains having a diameter of 5 mm or less in the steel sheet may be 10/5×5 $cm^2$ or less.

The steel sheet may further include 0.003 to 0.10 wt % of at least one element of Sb, Sn, Cr, Ni, Y, Ba, B, La, Mo, and Ce.

In the grain-oriented electrical steel sheet according to the exemplary embodiment of the present invention, the temperature condition is precisely controlled during the hot-rolled sheet annealing, so that an edge crack does not occur during cold rolling and the producibility and magnetic properties of the finally manufactured grained-oriented electrical steel sheet are excellent.

MODE FOR INVENTION

Figure 1:
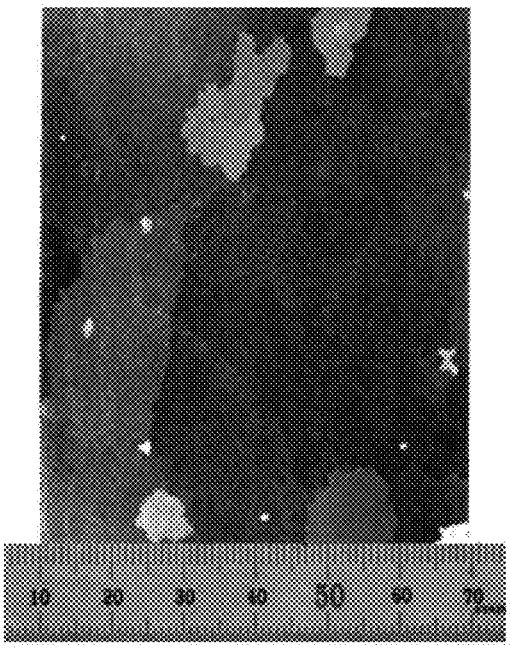
FIG. 1 illustrates a surface photograph after secondary recrystallization annealing of a steel sheet manufactured at 30° C./s as a temperature rise rate $t_1$ of a first temperature rise step in Example 4.
Figure 2:
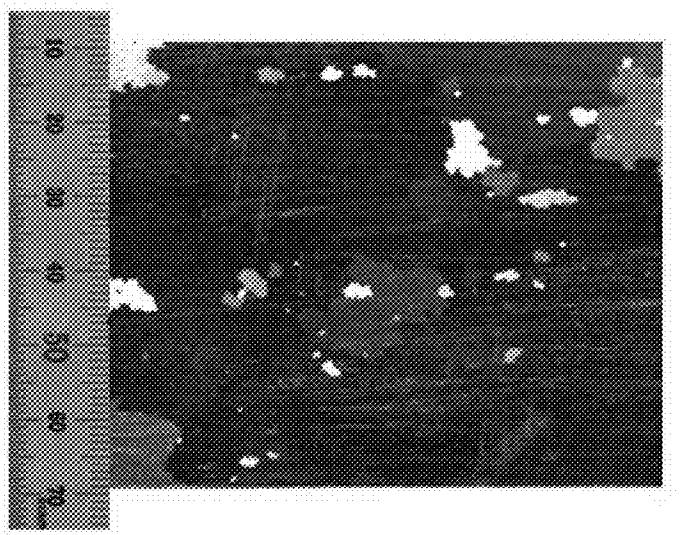
FIG. 2 illustrates a surface photograph after secondary recrystallization annealing of a steel sheet manufactured at 50° C./s as a temperature rise rate $t_1$ of a first temperature rise step in Example 4.

It will be understood that, although the terms first, second, third, etc. may be used herein to describe various elements, components, regions, layers, and/or sections, they are not limited thereto. These terms are only used to distinguish one element, component, region, layer, or section from another element, component, region, layer, or section. Thus, a first component, constituent element, or section described below may be referred to as a second component, constituent element, or section, without departing from the range of the present invention.

The terminologies used herein are used just to illustrate a specific exemplary embodiment, but are not intended to limit the present invention. It must be noted that, as used in the specification and the appended claims, the singular forms used herein include plural forms unless the context clearly dictates the contrary. It will be further understood that the term "comprises" or "includes", used in this specification, specifies stated properties, regions, integers, steps, operations, elements, and/or components, but does not preclude the presence or addition of other properties, regions, integers, steps, operations, elements, components, and/or groups.

When referring to a part as being "on" or "above" another part, it may be positioned directly on or above another part, or another part may be interposed therebetween. In contrast, when referring to a part being "directly above" another part, no other part is interposed therebetween.

Unless defined otherwise, all terms including technical and scientific terms used herein have the same meaning as commonly understood by one of ordinary skill in the art to which the present invention belongs. Terms defined in the commonly used dictionary are further interpreted as having a meaning consistent with the relevant technical literature and the present disclosure, and are not to be construed as ideal or very formal meanings unless defined otherwise.

Unless otherwise stated, % means % by weight, and 1 ppm is 0.0001% by weight.

In an exemplary embodiment of the present invention, the meaning of further comprising/including an additional element implies replacing the remaining iron (Fe) by an additional amount of the additional element.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

According to an exemplary embodiment of the present invention, a manufacturing method of a grain-oriented electrical steel sheet includes: preparing a slab; heating the slab; forming a hot-rolled sheet by hot-rolling the slab; performing hot-rolled sheet annealing on the hot-rolled sheet; forming a cold-rolled sheet by cold-rolling the hot-rolled sheet that has been completely subjected to the hot-rolled sheet annealing; performing first recrystallization annealing on the cold-rolled sheet; and performing second recrystallization annealing on the cold-rolled sheet that has been completely subjected to the first recrystallization annealing, wherein the hot-rolled sheet undergoes a first heating step, a second heating step, and a soaking step.

Hereinafter, each step will be described in detail.

First, the slab is prepared. In the exemplary embodiment of the present invention, a composition of the slab is not particularly limited, and slabs generally used in the field of grain-oriented electrical steel sheet may be used without limitation. Specifically, the slab may include Si (2.0 to 6.0 wt %), Al (0.05 wt % or less excluding 0 wt %), Mn (0.20 wt % or less excluding 0 wt %), P (0.08 wt % or less excluding 0 wt %), C (0.1 wt % or less excluding 0 wt %), N (0.01 wt % or less excluding 0 wt %), and S (0.01 wt % or less excluding 0 wt %), and a remainder may include Fe and other inevitable impurities.

Hereinafter, each component of the slab will be described.

Si: 2.0 to 6.0 wt %

Silicon (Si) is a basic composition of an electrical steel sheet, and plays a role in ameliorating iron loss by increasing specific resistance of the material. When a Si content is too small, the specific resistance decreases and an eddy current loss increases, and thus an iron loss characteristic becomes weak. When too much Si is added, ductility and toughness of the mechanical properties are decreased, so that plate breakage occurs frequently during the rolling process, and in the continuous annealing for commercial production, plate weldability is poor, and thus the producibility deteriorates. As a result, when the Si content is not controlled within the above-mentioned range, magnetic properties may be damaged and producibility may be deteriorated. Therefore, Si may be limited to 2.0 wt % to 6.0 wt %.

Al: 0.05 wt % or less

Aluminum (Al) combines with nitrogen ions introduced by ammonia gas as the atmospheric gas during a decarburization annealing process to form a nitride of an AlN type, and also combines the nitrogen ions, and Si and Mn existing in a solid solution state in the steel to form an (Al, Si, Mn)N-type nitride, thereby serving as a crystal grain growth inhibitor. When the Al content is too high, the crystal grain growth inhibiting ability may be drastically deteriorated by forming a very coarse nitride. Accordingly, the Al content may be 0.05 wt % or less. More specifically, the Al may be contained in an amount of 0.040 wt % or less.

Mn: 0.20 wt % or less

Manganese (Mn) has an effect of reducing iron loss by decreasing the eddy current loss by increasing the specific resistance in the same manner as Si, and also serves to form a crystal grain growth inhibitor by reacting with S existing in the steel to form a Mn-based compound or reacting with Al and nitrogen ions described above to form the (Al, Si, Mn)N-type nitride. When the content thereof is too large, an austenite phase transformation ratio increases during the second recrystallization annealing, so that the Goss texture may be seriously damaged to rapidly deteriorate the magnetic properties. More specifically, Mn may be contained in an amount of 0.20 wt % or less.

P: 0.08 wt % or less

Phosphorus (P) segregates in the grain boundaries and interferes with the movement of the grain boundaries, it may simultaneously play an auxiliary role of suppressing grain growth, and may have an effect of improving {110}<001> texture. However, when too much P is contained, the brittleness increases sharply to significantly deteriorate a cold rolling property. Accordingly, P is set to 0.08 wt % or less.

C: 0.1 wt % or less

Carbon (C), which is an element that contributes to grain refinement and elongation improvement by causing phase transformation between ferrite and austenite, is essential for an electric steel sheet having poor brittleness and a poor rolling property, but causes magnetic aging and deteriorates magnetic properties when remaining in the final product, so it is important to control the carbon content to an appropriate level. In particular, when the Si content is in the above-mentioned range, but C is not contained at an appropriate level, austenite phase transformation may not be sufficiently secured and the microtexture becomes non-uniform after the hot rolling and the hot-rolled sheet annealing, thereby deteriorating a cold rolling property. This problem may be solved by containing an appropriate amount of C. On the other hand, when too much C is contained, a coarse carbide such as pearlite or cementite may be formed on the microtexture after the hot-rolled sheet annealing, and thus the cold rolling property may be deteriorated and decarburization may not sufficiently performed, thereby deteriorating the magnetic properties of a final product. More specifically, C may be contained in an amount of 0.1 wt % or less. In the meantime, a decarburization process is added to a process such as first recrystallization annealing in the manufacturing process of the grain-oriented electrical steel sheet, and a final grain-oriented electrical steel sheet may contain 0.005 wt % or less of carbon.

N: 0.01 wt % or less

Nitrogen (N) is an important element that reacts with Al and Mn to form a compound such as AlN and (Al, Mn, Si)N, and may be contained in an amount of 0.01 wt % in the slab. When too much N is added, surface defects such as a blister due to nitrogen diffusion are caused in a post-hot-rolling process, and since excessive nitride is formed in a slab state, rolling is not easy to cause a manufacturing cost to be increased. More specifically, N may be contained in an amount of 0.01 wt % or less. Thereafter, reinforcement of the nitride for forming second recrystallization of the Goss texture is performed by introducing ammonia gas into atmospheric gas during a decarburization annealing process so as to allow the nitrogen ions to diffuse into the steel as nitrification treatment. Specifically, the finally manufactured grain-oriented electrical steel sheet may contain 0.0001 to 0.05 wt % of N.

S: 0.01 wt % or less

Sulfur (S) segregates at a center of the slab during casting to cause brittleness, and reacts with Mn in the steel to form a Mn-based sulfide, thereby making the microtexture non-uniform and deteriorating the rolling property. Therefore, it may not be preferable for S to be precipitated by adding more than an amount that is inevitably contained. Thus, Mn may be contained in an amount of 0.01 wt % or less.

Other elements

In addition to the above-mentioned elements, the slab may further include 0.003 to 0.10 wt % of at least one element of Sb, Sn, Cr, Ni, Y, Ba, B, La, Mo, and Ce. One of Sb, Sn, Cr, Ni, Y, Ba, B, La, Mo, and Ce is contained in an amount of 0.003 to 0.10 wt %, or two or more of Sb, Sn, Cr, Ni, Y, Ba, B, La, Mo, and Ce are contained, which indicates that an amount of 0.003 to 0.10 wt % is contained for each element.

The magnetic property may be improved by further adding the above-mentioned other element.

Next, the slab is heated. A heating temperature of the slab is not particularly limited, but the heating may be performed within a predetermined temperature range in which N and S to be solid-dissolved become incomplete solid solutions. When N and S become complete solid solutions, a large amount of precipitates such as nitride and sulfide may be finely precipitated during or after heat treatment of hot-rolled sheet annealing, and thus strength of the material may rapidly increase to not facilitate the cold rolling, which may cause a rise in manufacturing cost. In addition, it may not be easy to control crystal grain size of the first recrystallization, which acts as a crystal grain growth force of the Goss texture, and thus an appropriate Goss texture may not be formed in the final product, thereby deteriorating the magnetic properties. When a reheating temperature is too high, a surface of the slab may fuse and flow into a furnace body, thereby shortening a lifetime of the furnace. Specifically, the heating temperature of the slab may be in a range of 1050 to 1250° C.

Next, a hot-rolled sheet is formed by hot-rolling the slab. A hot rolling temperature is not particularly limited, and the hot rolling may be terminated at 950° C. or lower as an exemplary embodiment. Thereafter, it may be spirally wound at 600° C. or less while water cooling. A hot-rolled sheet may be formed by hot-rolling to a thickness of 1.5 to 5.0 mm.

In the completely hot-rolled sheet, columnar grain texture and equiaxed grain texture as slab texture are stretched in a hot-rolling direction and exist in a non-uniform manner, and coarse precipitates and carbides that exist in the slab are non-uniformly present in the grain and grain boundaries of the hot-rolled micro texture. Such non-uniform and coarse microtexture, precipitates, carbides, etc. deteriorate the rolling property of the material during cold rolling, which is a subsequent process, and further cause frequent plate breakage during rolling. Therefore, it is important to perform heat treatment of hot-rolled sheet annealing on the completely hot-rolled sheet to have uniform microtexture and uniformly distributed precipitates.

Next, the hot-rolled sheet is subjected to hot-rolled sheet annealing. In an exemplary embodiment of the present invention, the hot-rolled sheet undergoes a first heating step, a second heating step, and a soaking step.

A temperature rise rate $t_1$ of the first heating step and a temperature rise rate $t_2$ of the second heating step satisfy Formula 1.

$$5 \times t_2 \leq t_1 \quad \text{[Formula 1]}$$

When the temperature rise rate $t_1$ of the first heating step and a temperature rise rate $t_2$ of the second heating step satisfy Formula 1, a hot-rolled sheet having a low Vickers hardness is formed, and a number of edge cracks at an end portion (edge portion) of a cold-rolled sheet in a width direction in a cold rolling step to be described later decreases. On the other hand, when the temperature rise rate $t_1$ is relatively low, or the temperature rise rate $t_2$ is relatively high, a hot-rolled sheet having a high Vickers hardness is formed, and the number of edge cracks at the edge portion of the cold-rolled sheet increases sharply.

In this case, the first heating step is a step of heating the hot-rolled sheet to 600 to 900° C., and the second heating step may be a step of heating the hot-rolled sheet that has been completely subjected to the first heating step to a soaking temperature of the soaking step. Specifically, the hot-rolled sheet that has been completely subjected to the hot rolling process is cooled to room temperature (i.e., 15 to 25° C.). The first heating step is a step of heating the hot-rolled sheet that has been completely subjected to the hot rolling process to 600 to 900° C. Specifically, the first heating step is a step of heating the hot-rolled sheet to 750 to 850° C.

The second heating step is a step of heating the hot-rolled sheet that has been completely subjected to the first heating step, i.e., the hot-rolled sheet heated to 600 to 900° C., to a soaking temperature in the soaking step. In this case, the soaking temperature of the soaking step may be in a range of 850 to 1150° C. Specifically, the soaking temperature may be in a range of 900 to 1150° C.

The temperature rise rate $t_1$ of the first heating step may be in a range of 5 to 45° C./s. When the temperature rise rate $t_1$ of the first heating step is too high, a hot-rolled sheet having a high Vickers hardness is formed, and the number of edge cracks at the edge portion of the cold-rolled sheet increases sharply.

The temperature rise rate $t_2$ of the second heating step may be in a range of 1 to 6° C./s. When the temperature rise rate $t_2$ of the second heating step is too high, a hot-rolled sheet having a high Vickers hardness is formed, and the number of edge cracks at the edge portion of the cold-rolled sheet increases sharply.

The soaking step may include a first soaking step and a second soaking step. When the soaking step includes the first soaking step and the second soaking step, the second heating step indicates a step of raising the temperature to the soaking temperature of the first soaking step The first soaking step may not only maximize phase transformation between austenite and ferrite, but may also allow the soaking temperature to be between 850 and 1150° C. to re-solid-dissolve coarse and non-uniform precipitates in the steel. The first soaking step may be maintained for 10 seconds or more.

In the second soaking step, the soaking temperature may be controlled in order to finely and reliably re-precipitate the re-solid-dissolved precipitates in the steel during the first soaking step. The soaking temperature may be in a range of 850 to 950° C. The second soaking step may be maintained for 10 seconds or more.

The hot-rolled sheet that has thus been completely subjected to the hot-rolled sheet annealing may have a low Vickers hardness and a low strain hardening exponent. As such, the low Vickers hardness and strain hardening exponent may cause the number of edge cracks to be reduced in the cold rolling step to be described later.

In an exemplary embodiment of the present invention, the Vickers hardness indicates that the Vickers hardness is measured by performing press-fitting for 10 seconds under a load of 1 kg according to KSB08112003. The strain hardening exponent indicates what is measured in a room temperature tensile test at a speed of 10 min/min and an elongation percentage of 5 to 10% by using a tensile test specimen of the JIS-13B standard.

Specifically, the hot-rolled sheet that has been completely subjected to the hot-rolled sheet annealing may have Vickers hardness of 250 Hv or less after the performing of the hot-rolled sheet annealing. The hot-rolled sheet may have a strain hardening exponent of 0.2 or more after the performing of the hot-rolled sheet annealing. More specifically, the hot-rolled sheet may have a Vickers hardness of 200 Hv or less and a strain hardening exponent of 0.3 or higher.

Next, a cold rolled sheet is formed by cold-rolling the hot-rolled sheet. The cold rolling is performed by a cold rolling method using a reverse rolling mill or a tandem rolling mill, and including single cold rolling, a plurality of cold rollings, and a plurality of cold rollings with intermediate annealing to form a cold rolled sheet having a thickness of 0.1 mm to 0.7 mm. Warm rolling in which the temperature of the steel sheet is maintained at 100° C. or higher during cold rolling may be performed. In addition, a final rolling reduction through cold rolling may be in a range of 50 to 95%.

As described above in the exemplary embodiment of the present invention, since the hardness of the hot-rolled sheet after the hot-rolled sheet annealing is low and the strain hardening exponent is low, the number of edge cracks formed at the end portion of the cold-rolled sheet in the thickness direction in the cold rolling step may be reduced. In the exemplary embodiment of the present invention, an edge crack indicates a crack having a depth of 5 mm or more existing at the end portion (edge portion) of the cold-rolled sheet in the thickness direction after cold rolling. Specifically, 4 or less edge cracks per 50 cm may occur in the longitudinal direction of the cold-rolled sheet.

Next, the cold-rolled sheet is subjected to first recrystallization annealing. First recrystallization occurs in which the core of the Goss grain is generated in the first recrystallization annealing step. Decarburization and nitriding of the steel sheet can be performed during the primary recrystallization annealing process. For decarburization and nitriding, the first recrystallization annealing can be performed in a mixed gas atmosphere of aqueous vapor, hydrogen, and ammonia. For decarburization, it may annealed at a temperature of 950° C. or less and a dew point temperature of 50° C. to 70° C. When the temperature exceeds 950° C., recrystallized grains grow to a great extent and the crystal growth force drops, so that stable second recrystallization is not formed. An annealing time is not a serious problem in achieving the effect of the present invention, but it is preferable to treat the annealing within 5 minutes in consideration of producibility. Specifically, the first recrystallization annealing may be performed at a temperature of 700 to 950° C.

When nitrogen ions are introduced into the steel sheet using ammonia gas for nitriding to form nitrides such as (Al, Si, Mn)N and AlN, which are precipitates, there is no problem in achieving the effect of the present invention in any of methods of performing the nitriding treatment after the decarburization and recrystallization, of simultaneously performing the nitriding treatment to perform the decarburization and the nitriding treatment at the same time, or of performing the nitriding treatment first, followed by the decarburization annealing.

Next, second recrystallization annealing is performed on the cold-rolled sheet that has been completely subjected to the first recrystallization annealing. In this case, the second recrystallization annealing may be performed after the annealing separator is applied to the cold-rolled sheet that has been completely subjected to the first recrystallization annealing. In this case, the annealing separator is not particularly limited, and an annealing separator containing MgO as a main component may be used.

In the second recrystallization annealing step, {110}<001> texture is formed by second recrystallization, an insulating property is imparted by formation of a glassy film by a reaction between an oxide layer on the surface formed by the first recrystallization annealing and MgO, and impurities that harm the magnetic properties are removed. For the second recrystallization annealing step, in a heating period before the second recrystallization, the second recrystallization may be well developed by protecting an nitriding agent, which is a particle growth inhibitor, by using a mixed gas of nitrogen and hydrogen, and after the second recrystallization is completed, any method of using a 100% hydrogen atmosphere or a mixed atmosphere of nitrogen and hydrogen has no problem in archiving the effect of the present invention, and the impurities are removed by maintaining it for a long time.

Meanwhile, the present inventors found that a material of the above-described annealed hot-rolled sheet has a great influence on the magnetic properties of the final product.

When the material of the annealed hot-rolled sheet which is light-weighted is cold-rolled, if an edge crack occurs at an edge portion of the cold-rolled sheet, a rolling speed is reduced, and thus a cold rolling temperature is also decreased. When the rolling temperature is reduced in this way, the fraction or the degree of integration of the Goss texture will deteriorate, and thus the magnetic properties of the final product will deteriorate. When the edge cracks occurring during the cool rolling are reduced by controlling the material of the annealed hot-rolled sheet, the fraction or the degree of integration of the Goss texture may be improved to enhance the magnetic properties of the final product. The present inventors also found that when the edge cracks occurring during the cool rolling are reduced by controlling the material of the annealed hot-rolled sheet, the number of crystal grains having a diameter of about 5 mm or less, which cause deterioration of the magnetic properties of the final product, i.e., existing in the second recrystallized crystal grains, is reduced. Specifically, a number of crystal grains having a diameter of 5 mm or less in the steel sheet is 10/5×5 $cm^2$ or less.

Thereafter, an insulating film may be formed on the surface of the grain-oriented electrical steel sheet or a magnetic domain refining treatment may be carried out, if necessary. In the exemplary embodiment of the present invention, an alloy component of the grain-oriented electrical steel sheet indicates a base steel sheet excluding a coating layer such as an insulating film.

The grain-oriented electrical steel sheet according to an exemplary embodiment of the present invention may further include Si (2.0 to 6.0 wt %), Al (0.05 wt % or less excluding 0 wt %), Mn (0.20 wt % or less excluding 0 wt %), P (0.08 wt % or less excluding 0 wt %), C (0.05 wt % or less excluding 0 wt %), N (0.0001 to 0.05 wt %), and S (0.01 wt % or less excluding 0 wt %), and a remainder may include Fe and other inevitable impurities. In addition, a number of crystal grains having a diameter of 5 mm or less in the steel sheet may be 10/5×5 $cm^2$ or less.

The steel sheet may further include 0.003 to 0.10 wt % of at least one element of Sb, Sn, Cr, Ni, Y, Ba, B, La, Mo, and Ce.

The alloy composition and the number of crystal grains of the grain-oriented electrical steel sheet are the same as those of the above-described method for manufacturing the grain-oriented electrical steel sheet, and thus a duplicate description will be omitted.

Hereinafter, the present invention will be described in more detail through examples. However, the examples are only for illustrating the present invention, and the present invention is not limited thereto.

Example 1

A slab containing Si (3.3 wt %), Mn (0.011 wt %), Al (0.004 wt %), C (0.06 wt %), N (0.005 wt %), S (0.005 wt %), Sb (0.03 wt %), Sn (0.08 wt %), P (0.03 wt %), and Cr (0.04 wt %), and a balance including Fe and other inevitable impurities, was heated at 1150° C., and then hot-rolled to a thickness of 2.3 m. Thereafter, a temperature of the slab was raised to 800° C. at a temperature rise rate described in Table 1 (first heating step), and the temperature was raised from 800° C. to 1060° C. at a temperature rise rate described in Table 1 (second heating step). Hot-rolled sheet annealing was performed by carrying out a first soaking treatment at 1060° C. for 20 seconds and a second soaking treatment at 900° C. for 20 seconds, and then by carrying out cooling. A hot-rolled sheet that had been completely subjected to the hot-rolled sheet annealing was pickled, and then cold-rolled once to a thickness of 0.23 mm, and a thus-formed cool-rolled sheet was subjected to primary recrystallization annealing at a temperature of 850° C. in a humid atmosphere of a mixed gas of hydrogen, nitrogen, and ammonia for 200 seconds to perform simultaneous decarburization and nitridation so that a carbon content was 50 ppm or less and a nitrogen content was 180 ppm.

This steel sheet was coated with MgO as an annealing separator, and subjected to second recrystallization annealing. The second recrystallization annealing was performed by heating it in a mixed gas atmosphere of 25 vol % of nitrogen and 75 vol % of hydrogen up to 1200° C., and maintaining it in an atmosphere of 100 vol % of hydrogen after reaching 1200° C. for 10 hours or more, and then performing furnace cooling. The following Table 1 summarizes measurement values of a degree of occurrence of edge cracks in the cold-rolled sheet, occurrence of fracture during cold rolling, and a magnetic characteristic after second recrystallization annealing depending on a change in the temperature rise rate during annealing of a hot-rolled sheet.

The edge cracks were measured for the number of cracks having a depth of 5 mm or more existing at an end portion (edge portion) of the cold-rolled sheet in a thickness direction after cold-rolling per 50 cm in a longitudinal direction. The iron loss and magnetic flux density were measured by single sheet measurement, the iron loss was measured until magnetization at 1.7 Tesla at 50 Hz, and a magnitude (Tesla) of magnetic flux density induced under a magnetic field of 1000 A/m was measured.

TABLE 1

| Temperature rise rate (° C./s) | | | | | |
|---|---|---|---|---|---|
| 800° C. or less ($t_1$) | Higher than 800° C. ($t_2$) | Number of edge cracks | Fracture | Iron loss ($W_{17/50}$, W/kg) | Flux density ($B_{10}$, Tesla) |
| 10 | 5 | 5 | ○ | 0.88 | 1.89 |
| 10 | 2 | 1 | X | 0.79 | 1.92 |
| 20 | 8 | 5 | ○ | 0.88 | 1.89 |
| 20 | 4 | 1 | X | 0.81 | 1.92 |

TABLE 1-continued

| Temperature rise rate (° C./s) | | | | | |
|---|---|---|---|---|---|
| 800° C. or less ($t_1$) | Higher than 800° C. ($t_2$) | Number of edge cracks | Fracture | Iron loss ($W_{17/50}$, W/kg) | Flux density ($B_{10}$, Tesla) |
| 30 | 12 | 5 | ○ | 0.87 | 1.89 |
| 30 | 6 | 2 | X | 0.82 | 1.91 |
| 45 | 12 | 5 | ○ | 0.88 | 1.89 |
| 45 | 9 | 2 | X | 0.82 | 1.92 |
| 50 | 12 | 6 | ○ | 0.88 | 1.89 |
| 50 | 10 | 6 | ○ | 0.87 | 1.90 |
| 60 | 15 | 8 | ○ | 0.88 | 1.89 |
| 60 | 12 | 7 | ○ | 0.87 | 1.90 |

As shown in Table 1, when the temperature rise rate was appropriately adjusted, the edge cracks were few and no breakage occurred during cold rolling, and the magnetic characteristic of the finally manufactured grained-oriented electrical steel sheet was excellent.

Example 2

A slab containing Si (3.3 wt %), Mn (0.011 wt %), Al (0.004 wt %), C (0.06 wt %), N (0.005 wt %), S (0.005 wt %), Sb (0.03 wt %), Sn (0.0 wt %), P (0.03 wt %), Cr (0.04 wt %), and Ni (0.01 Wt %), and a balance including Fe and other inevitable impurities, was heated at 1150° C., and then hot-rolled to a thickness of 2.3 m. Thereafter, a temperature of the slab was raised to 800° C. at a temperature rise rate of 30° C./s (first heating step), and the temperature was raised from 800° C. to a first soaking temperature at the temperature rise rate of 6° C./s (second heating step). The hot-rolled sheet annealing was performed by carrying out the first soaking treatment at a first cracking temperature listed in Table 2 for 20 seconds and the second soaking treatment at 900° C. for 30 seconds. A hot-rolled sheet that had been completely subjected to the hot-rolled sheet annealing was pickled, and then cold-rolled once to a thickness of 0.23 mm, and a thus-formed cool-rolled sheet was subjected to primary recrystallization annealing at a temperature of 850° C. in a humid atmosphere of a mixed gas of hydrogen, nitrogen, and ammonia for 200 seconds to perform simultaneous decarburization and nitridation so that a carbon content was 50 ppm or less and a nitrogen content was 180 ppm.

This steel sheet was coated with MgO as an annealing separator, and subjected to second recrystallization annealing. The second recrystallization annealing was performed by heating it in a mixed gas atmosphere of 25 vol % of nitrogen and 75 vol % of hydrogen up to 1200° C., and maintaining it in an atmosphere of 100 vol % of hydrogen after reaching 1200° C., for 10 hours or more, and then performing furnace cooling. The following Table 2 summarizes measurement values of a degree of occurrence of edge cracks in the cold-rolled sheet, occurrence of fracture during cold rolling, and a magnetic characteristic after the second recrystallization annealing depending on a change in the first soaking temperature during annealing of a hot-rolled sheet.

TABLE 2

| First soaking temperature (° C.) | Number of edge cracks | Fracture | Iron loss ($W_{17/50}$, W/kg) | Flux density (B10, Tesla) |
|---|---|---|---|---|
| 1200 | 11 | ○ | 0.91 | 1.89 |
| 1170 | 9 | ○ | 0.86 | 1.90 |
| 1150 | 4 | X | 0.83 | 1.91 |

TABLE 2-continued

| First soaking temperature (° C.) | Number of edge cracks | Fracture | Iron loss ($W_{17/50}$, W/kg) | Flux density (B10, Tesla) |
|---|---|---|---|---|
| 1100 | 3 | X | 0.82 | 1.91 |
| 1080 | 2 | X | 0.81 | 1.92 |
| 1060 | 1 | X | 0.81 | 1.92 |
| 1020 | 1 | X | 0.82 | 1.92 |
| 1000 | 3 | X | 0.83 | 1.91 |
| 970 | 6 | ○ | 0.86 | 1.89 |
| 950 | 7 | ○ | 0.88 | 1.90 |

As shown in Table 2, when the first soaking temperature was appropriately adjusted, the edge cracks were few and no breakage occurred during cold rolling, and the magnetic characteristic of the finally manufactured grained-oriented electrical steel sheet was excellent.

Example 3

A slab containing Si (3.3 wt %), Mn (0.015 wt %), Al (0.035 wt %), C (0.055 wt %), N (0.005 wt %), S (0.005 wt %), Sb (0.04 wt %), Sn (0.07 wt %), P (0.02 wt %), Cr (0.05 wt %), and Ni (0.012 Wt %), and a balance including Fe and other inevitable impurities, was heated at 1150° C., and then hot-rolled to a thickness of 2.3 m. Thereafter, a temperature of the slab was raised to 800° C. at 30° C./s (first heating step), and the temperature was raised from 800° C. to 1060° C. at the temperature rise rate of 6° C./s (second heating step). The hot-rolled annealing was performed by carrying out the first soaking treatment at 1060° C. for 30 seconds, and then the second soaking treatment at a second soaking temperature summarized in Table 3 for 45 seconds. A hot-rolled sheet that had been completely subjected to the hot-rolled sheet annealing was pickled, and then cold-rolled once to a thickness of 0.23 mm, and a thus-formed cool-rolled sheet was subjected to primary recrystallization annealing at a temperature of 850° C. in a humid atmosphere of a mixed gas of hydrogen, nitrogen, and ammonia for 200 seconds to perform simultaneous decarburization and nitridation so that a carbon content was 50 ppm or less and a nitrogen content was 180 ppm.

This steel sheet was coated with MgO as an annealing separator, and subjected to second recrystallization annealing. The second recrystallization annealing was performed by heating it in a mixed gas atmosphere of 25 vol % of nitrogen and 75 vol % of hydrogen up to 1200° C., and maintaining it in an atmosphere of 100 vol % of hydrogen after reaching 1200° C. for 10 hours or more, and then performing furnace cooling. The following Table 3 summarizes measurement values of a degree of occurrence of edge cracks in the cold-rolled sheet, occurrence of fracture during cold rolling, and a magnetic characteristic after the second recrystallization annealing depending on a change in the first soaking temperature during annealing of a hot-rolled sheet.

TABLE 3

| Second soaking temperature (° C.) | Number of edge cracks | Fracture | Iron loss ($W_{17/50}$, W/kg) | Flux density (B10, Tesla) |
|---|---|---|---|---|
| 990 | 7 | ○ | 0.92 | 1.89 |
| 970 | 7 | ○ | 0.86 | 1.90 |
| 950 | 3 | X | 0.79 | 1.93 |
| 920 | 2 | X | 0.80 | 1.92 |
| 900 | 1 | X | 0.81 | 1.92 |
| 880 | 0 | X | 0.81 | 1.92 |

TABLE 3-continued

| Second soaking temperature (° C.) | Number of edge cracks | Fracture | Iron loss ($W_{17/50}$, W/kg) | Flux density (B10, Tesla) |
|---|---|---|---|---|
| 850 | 2 | X | 0.83 | 1.91 |
| 830 | 5 | ○ | 0.87 | 1.90 |
| 810 | 7 | ○ | 0.88 | 1.90 |

As shown in Table 3, when the second soaking temperature was appropriately adjusted, the edge cracks were few and no breakage occurred during cold rolling, and the magnetic characteristic of the finally manufactured grained-oriented electrical steel sheet was excellent.

Example 4

A slab containing Si (3.6 wt %), Mn (0.012 wt %), Al (0.003 wt %), C (0.07 wt %), N (0.004 wt %), S (0.004 wt %), Sb (0.035 wt %), Sn (0.077 wt %), P (0.025 wt %), and Cr (0.06 wt %), and a balance including Fe and other inevitable impurities, was heated at 1150° C., and then hot-rolled to a thickness of 2.3 m. Thereafter, a temperature of the slab was raised to 800° C. at a temperature rise rate summarized in the following Table 4 (first heating step), and the temperature was raised from 800° C. to 1060° C. at the temperature rise rate summarized in Table 4 (second heating step). The hot-rolled sheet annealing was performed by carrying out the first soaking treatment at 1060° C. for 40 seconds and the second soaking treatment at 900° C. for 60 seconds, and then by carrying out cooling. A hot-rolled sheet that had been completely subjected to the hot-rolled sheet annealing was pickled, and then cold-rolled once to a thickness of 0.23 mm, and a thus-formed cool-rolled sheet was subjected to primary recrystallization annealing at a temperature of 850° C. in a humid atmosphere of a mixed gas of hydrogen, nitrogen, and ammonia for 200 seconds to perform simultaneous decarburization and nitridation so that a carbon content was 50 ppm or less and a nitrogen content was 180 ppm.

This steel sheet was coated with MgO as an annealing separator, and subjected to second recrystallization annealing. The second recrystallization annealing was performed by heating it in a mixed gas atmosphere of 25 vol % of nitrogen and 75 vol % of hydrogen up to 1200° C., and maintaining it in an atmosphere of 100 vol % of hydrogen after reaching 1200° C. for 10 hours or more, and then performing furnace cooling. The following Table 4 summarizes measurement values of a magnetic characteristic and the number of crystal grains having a diameter of 5 mm or less after second recrystallization annealing depending on a change in the temperature rise rate during annealing of hot-rolled sheet.

TABLE 4

| Temperature rise rate (° C./s) | | Iron loss ($W_{17/50}$, W/kg) | Flux density (B10, Tesla) | Number of crystal grains having diameter of 5 mm or less |
|---|---|---|---|---|
| 800° C. or less ($t_1$) | Higher than 800° C. ($t_2$) | | | |
| 10 | 2 | 0.77 | 1.92 | 5.1 |
| 20 | 4 | 0.79 | 1.92 | 5.2 |
| 30 | 6 | 0.80 | 1.91 | 7.6 |
| 45 | 8 | 0.82 | 1.92 | 9.5 |
| 50 | 11 | 0.90 | 1.89 | 12.1 |

As shown in Table 1, when the temperature rise rate was appropriately adjusted, the number of crystal grains having a diameter of 5 mm or less was 10/5×5 $cm^2$ or less and the magnetic characteristic of the finally manufactured grained-oriented electrical steel sheet were also excellent.

Example 5

Figure 3:
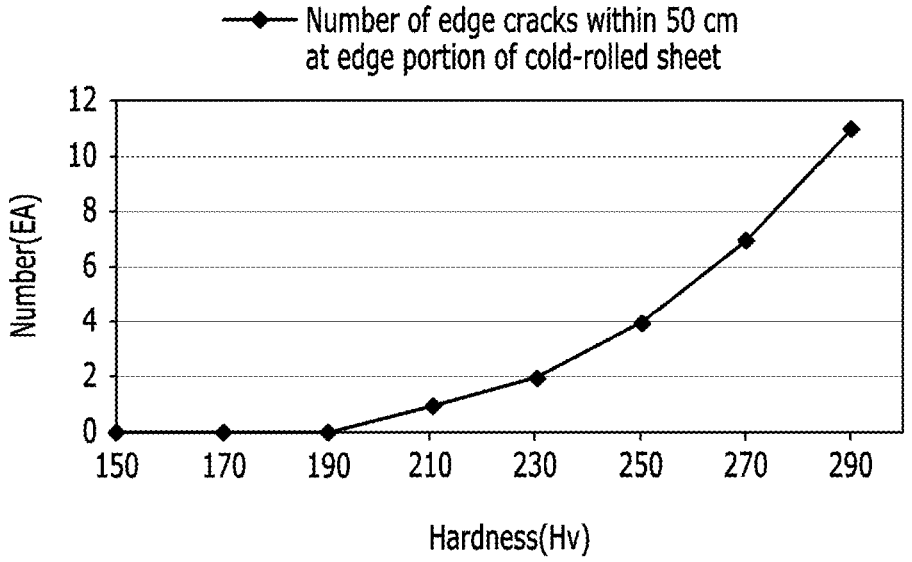
FIG. 3 illustrates a graph comparing a number of edge cracks of cold-rolled sheet depending on Vickers hardness of a hot-rolled sheet in Example 5.

For the grain-oriented electrical steel sheet manufactured in Example 1 to Example 4, the Vickers hardness (Hv) of the hot-rolled sheet that had been completely subjected to the hot-rolled sheet annealing, and the number of edge cracks in the cold-rolled sheet after cold rolling, are summarized in FIG. 3.

The Vickers hardness was measured by press-fitting for 10 seconds under a load of 1 kg based on KSB08112003.

As illustrated in FIG. 3, it can be seen that the number of edge cracks in the cold-rolled sheet is increased as the Vickers hardness (Hv) of the hot-rolled sheet that had been completely subjected to the hot-rolled sheet annealing is increased.

Figure 4:
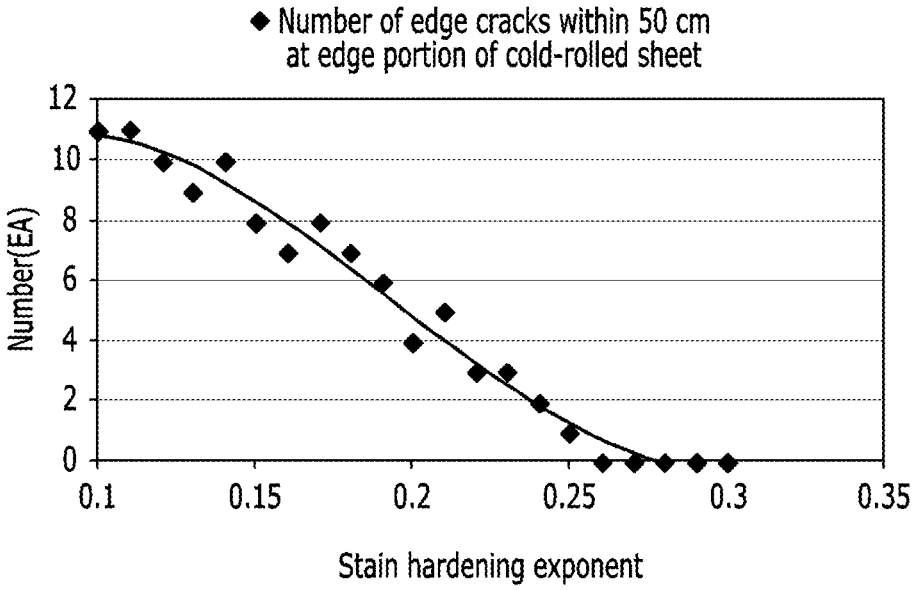
FIG. 4 illustrates a graph comparing a number of edge cracks of a cold-rolled sheet depending on strain hardening exponent of a hot-rolled sheet in Example 5.

For the grain-oriented electrical steel sheet manufactured in Example 1 to Example 4, the strain hardening exponent of the hot-rolled sheet that had been completely subjected to the hot-rolled sheet annealing, and the number of edge cracks in the cold-rolled steel sheet after cold rolling, are summarized in FIG. 4.

The strain hardening exponent was measured in a room temperature tensile test at a speed of 10 min/min and an elongation percentage of 5 to 10% by using a tensile test specimen of JIS-13B standard.

As illustrated in FIG. 4, it can be seen that the number of edge cracks in the cold-rolled sheet is reduced as the strain hardening exponent of the hot-rolled sheet that has been completely subjected to the hot-rolled sheet annealing is increased.

The invention claimed is:

1. A manufacturing method of a grain-oriented electrical steel sheet, the method comprising:

preparing a slab;

heating the slab;

forming a hot-rolled sheet by hot-rolling the slab;

performing hot-rolled sheet annealing on the hot-rolled sheet;

forming a cold-rolled sheet by cold-rolling the hot-rolled sheet that has been completely subjected to the hot-rolled sheet annealing;

performing first recrystallization annealing on the cold-rolled sheet; and performing second recrystallization annealing on the cold-rolled sheet that has been completely subjected to the first recrystallization annealing, wherein the hot-rolled sheet undergoes a first heating step, a second heating step, and a soaking step, and a temperature rise rate $t_1$ of the first heating step and a temperature rise rate $t_2$ of the second heating step satisfy Formula 1, wherein the first heating step is a step of heating the hot-rolled sheet from 750 to 850° C., and the second heating step is a step of heating the hot-rolled sheet that has been completely subjected to the first heating step to a soaking temperature of the soaking step, wherein the soaking step includes a first soaking step and a second soaking step, and a soaking temperature of the first soaking step is in a range of 850° C. to 1150° C., wherein a soaking temperature of the second soaking step is in a range of 850° C. to 950° C., wherein a number of crystal grains having a diameter of 5 mm or less in the steel sheet is 10/5×5 $cm^2$ or less after the performing of the second recrystallization annealing:

$$5 \times t_2 \leq t_1. \quad \text{[Formula 1]}$$

2. The manufacturing method of claim 1, wherein the temperature rise rate $t_1$ is in a range of 5 to 45° C./s.

3. The manufacturing method of claim 1, wherein the slab includes Si (2.0 to 6.0 wt %), Al (0.05 wt % or less excluding 0 wt %), Mn (0.20 wt % or less excluding 0 wt %), P (0.08 wt % or less excluding 0 wt %), C (0.1 wt % or less excluding 0 wt %), N (0.01 wt % or less excluding 0 wt %), and S (0.01 wt % or less excluding 0 wt %), and a remainder includes Fe and other inevitable impurities.

4. The manufacturing method of claim 3, wherein the slab further includes 0.003 to 0.10 wt % of at least one element of Sb, Sn, Cr, Ni, Y, Ba, B, La, Mo, and Ce.

5. The manufacturing method of claim 1, wherein the hot-rolled sheet that has been completely subjected to the hot-rolled sheet annealing has Vickers hardness of 250 Hv or less after the performing of the hot-rolled sheet annealing.

6. The manufacturing method of claim 1, wherein the hot-rolled sheet has a strain hardening exponent of 0.2 or more after the performing of the hot-rolled sheet annealing.

* * * * *